US009340991B2

(12) United States Patent
Yandell

(10) Patent No.: US 9,340,991 B2
(45) Date of Patent: May 17, 2016

(54) METHODS AND APPARATUS FOR SUPPORTING A COLUMN

(71) Applicant: Michael Shaun Yandell, Elk Grove, CA (US)

(72) Inventor: Michael Shaun Yandell, Elk Grove, CA (US)

( * ) Notice: Subject to any disclaimer, the term of this patent is extended or adjusted under 35 U.S.C. 154(b) by 0 days.

(21) Appl. No.: 14/485,811

(22) Filed: Sep. 15, 2014

(65) Prior Publication Data

US 2016/0076270 A1 Mar. 17, 2016

(51) Int. Cl.
*E04H 12/20* (2006.01)
*E04H 12/22* (2006.01)
*E02D 27/42* (2006.01)

(52) U.S. Cl.
CPC ..... *E04H 12/20* (2013.01); *E02D 27/42* (2013.01); *E04H 12/2215* (2013.01); *E04H 12/2238* (2013.01); *E04H 12/2253* (2013.01)

(58) Field of Classification Search
CPC . E04H 12/20; E04H 12/2215; E04H 12/2253; E04H 12/2238; E04H 12/2292; E02D 27/42
USPC ..... 52/153, 514, 165, 155, 156, 158, 159, 52/170, 169.13, 296
See application file for complete search history.

(56) References Cited

U.S. PATENT DOCUMENTS 132,259 A * 10/1872 Drake ..... 52/146
164,788 A * 6/1875 Wheelock ..... 52/146
177,340 A * 5/1876 Leonard ..... 52/146
226,790 A * 4/1880 Reed ..... 52/146
254,350 A * 2/1882 Mann ..... 52/146
261,346 A * 7/1882 Hayden ..... 52/146
266,261 A * 10/1882 Copeland ..... 52/154
305,571 A * 9/1884 Cheney ..... 256/32
364,077 A * 5/1887 Addis ..... 52/146
502,343 A * 8/1893 Anderson ..... 256/47
539,411 A * 5/1895 Brown ..... 52/149
542,908 A * 7/1895 Van Wert ..... 52/156
580,311 A * 4/1897 Hammett ..... 256/64
749,944 A * 1/1904 McFeron ..... 52/146
774,687 A * 11/1904 Miller ..... 52/148
1,038,147 A * 9/1912 Johnson ..... 52/165
1,805,251 A * 5/1931 Matthews ..... E04H 12/20 52/147
2,265,452 A * 12/1941 Ruggieri ..... E04H 12/04 52/170
2,876,974 A * 3/1959 Liftman ..... E04H 12/2215 248/156
2,903,856 A * 9/1959 Dean ..... E04H 12/20 405/225
3,159,248 A * 12/1964 Biehn ..... E04H 17/08 52/152
3,683,739 A * 8/1972 Garretson ..... E04H 12/2292 256/47
4,120,125 A * 10/1978 Cvetan ..... E04H 12/2215 52/156
4,156,332 A * 5/1979 Thompson ..... E04H 12/2215 52/165
4,275,535 A * 6/1981 Stalzer ..... E02D 27/42 116/209

(Continued)

*Primary Examiner* — Brian Glessner
*Assistant Examiner* — Adam Barlow

(57) ABSTRACT

The present invention comprises an anchored support to buttress a column, comprising at least one rigid member configured to be coupled to at least one section of a column; and at least an additional rigid member configured to be detachably coupled to the at least one rigid member and configured to be positioned at least partially within a supportive medium, wherein the at least an additional rigid member comprises a structure configured to prevent rotation of the at least an additional member.

2 Claims, 6 Drawing Sheets

(56) References Cited

U.S. PATENT DOCUMENTS 4,296,584 A * 10/1981 Lempa, Jr. ..... E04H 12/2292 52/169.13
4,343,449 A * 8/1982 Osthus ..... E04H 12/2215 248/121
4,644,713 A * 2/1987 Lehman ..... E04H 12/2215 52/165
5,921,035 A * 7/1999 Kempf ..... E01F 9/0117 248/545
6,526,722 B1 * 3/2003 Pangburn ..... E04H 12/2292 256/35
D650,095 S * 12/2011 Smolinski ..... D25/133
D662,614 S * 6/2012 Storey ..... D25/134
9,103,090 B2 * 8/2015 Bushore ..... E02D 27/42
2001/0045553 A1 * 11/2001 Pilcher ..... E04H 12/2292 256/64
2004/0000115 A1 * 1/2004 Cox ..... E04H 12/2292 52/514
2004/0159055 A1 * 8/2004 Stone ..... E01F 9/0117 52/153
2004/0221543 A1 * 11/2004 Eleas ..... E02D 5/56 52/153
2006/0265973 A1 * 11/2006 Guthrie ..... E02D 5/74 52/153
2013/0037066 A1 * 2/2013 Dorr ..... E04H 12/2215 135/16
2013/0160380 A1 * 6/2013 Atchley ..... E04H 12/2223 52/157
2014/0311083 A1 * 10/2014 Madril ..... E04H 12/347 52/741.14
2015/0184415 A1 * 7/2015 Bushore ..... E02D 27/42 52/831

* cited by examiner

METHODS AND APPARATUS FOR SUPPORTING A COLUMN

TECHNICAL FIELD OF THE INVENTION

Embodiments of the invention are related to apparatuses, systems, structures, and methods supporting or reinforcing a column or post.

BACKGROUND OF THE INVENTION

Columns and posts are set in the ground to support fences, signs, trees, and other structures. The columns and posts may be positioned directly in the ground, or, the part of the column or post that is below ground may be embedded in a curable material, such as for example concrete. The part of the column or post below ground level may, whether embedded in concrete or not, deteriorate or rot, resulting in the supported structure at least partially collapsing, requiring that the column or post be replaced or repaired. Previous systems used to reinforce columns or posts have been difficult to install, expensive, inherently weak, or aesthetically offensive.

BRIEF SUMMARY OF THE INVENTION

In some embodiments, the present invention comprises an anchored support to buttress a column, comprising at least one rigid member configured to be coupled to at least one section of a column; and at least an additional rigid member configured to be detachably coupled to the at least one rigid member and configured to be positioned at least partially within a supportive medium, wherein the at least an additional rigid member comprises a structure configured to prevent rotation of the at least an additional member.

In further embodiments of the present invention, the invention comprises a method of anchoring a column, the method comprising coupling to at least one section of a column adjacent to a supportive foundation at least one rigid member being joined to at least an additional rigid member having a structure configured to prevent rotation of the at least an additional rigid member. The method further comprises positioning the at least an additional rigid member at least partially within a void, the void being within a supportive medium adjacent to the column. The method further comprises placing around the at least an additional rigid member a supportive material configured to prevent substantial movement of the at least an additional rigid member.

In additional embodiments of the present invention, the present invention comprises a anchor for supporting a column comprising a first channeled section configured to be attached to a column, the first channeled section having a first channel wall of the first channel section and a second channeled section configured to be attached to the first channeled section and extending at an angle therefrom. The second channeled section may comprise a first channel wall of the second channeled section extending the length of the second channeled section along a first edge of the second channel section. The second channeled section may further comprise a second channel wall extending the length of the second channel section along a second edge of the second channel section, the second edge of the second channel section being opposite the first edge of the second channel section. The present invention may further comprise a first fastening member attached to the second channeled section opposite the first channel wall and the second channel wall. The present invention may further comprise a tubular section having a second fastening member at a proximal end of the tubular section, the second fastening member configured to detachably couple to the first fastening member of the second channel section, wherein the tubular section extends in a direction substantially opposite of the first channel section and configured to be anchored within a supportive medium. The second coupling member may be configured to decouple from the first coupling member. The tubular section may further comprise a structure fixedly attached to the tubular section and configured to prevent rotation of the tubular section within a supportive medium.

Further embodiments of the invention include a method of forming a column-supporting anchor, comprising: forming at least one rigid member; coupling at least an additional rigid member to the at least one rigid member; and attaching to the at least an additional rigid member a structure configured to prevent rotation of the at least an additional rigid member when the structure is in contact with an external supportive material.

BRIEF DESCRIPTION OF DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION

The illustrations presented herein are, in some instances, not actual views of any particular column, pillar, tree, fence, sign or other object, but are merely idealized representations which are employed to describe the present invention. Additionally, elements common between figures may retain the same numerical designation.

Home owners, landlords, business owners, lawn and yard care professionals, and others require a solution to the problem of reinforcing or supporting weakened columns and posts found on fences, signs, mailboxes, trees, and other posts and pillars when such posts and columns deteriorate, rot, rust, or break. In order to simply and cost effectively provide a way to fix such columns, there is a need to provide a system of strengthening such columns that does not require the entire fence to be replaced.

Home owners, landlords, business owners, lawn and yard care professionals and others at times have the need to remove the particular column, post, tree, pillar, fence, sign, or other structure being supported. Current systems make this at best problematic and difficult and at worst, impossible to do, as the systems are either permanently fixed within the ground or other supportive medium. These can only be removed by breaking up and removing a large amount of concrete or other supportive medium. Therefore, currently, there are no systems which provide the ability to reinforce columns and to be easily installed and uninstalled.

In order that the invention may be more fully understood, it will now be described, by way of example, with reference to the accompanying drawings, FIGS. 1 through 7.

Figure 1:
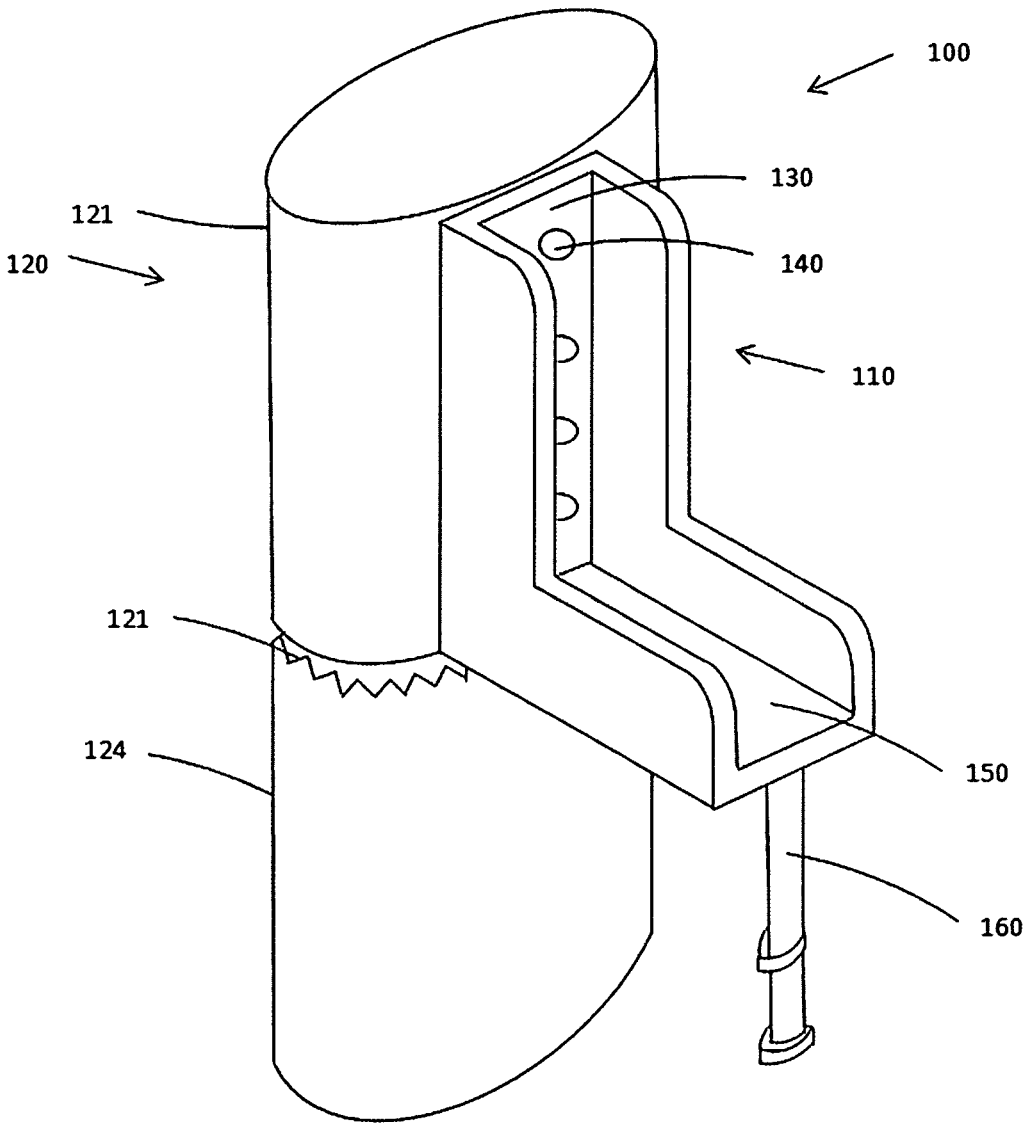
FIG. 1 illustrates a perspective view of a anchored support attached to an at least partially fractured column.
Figure 2:
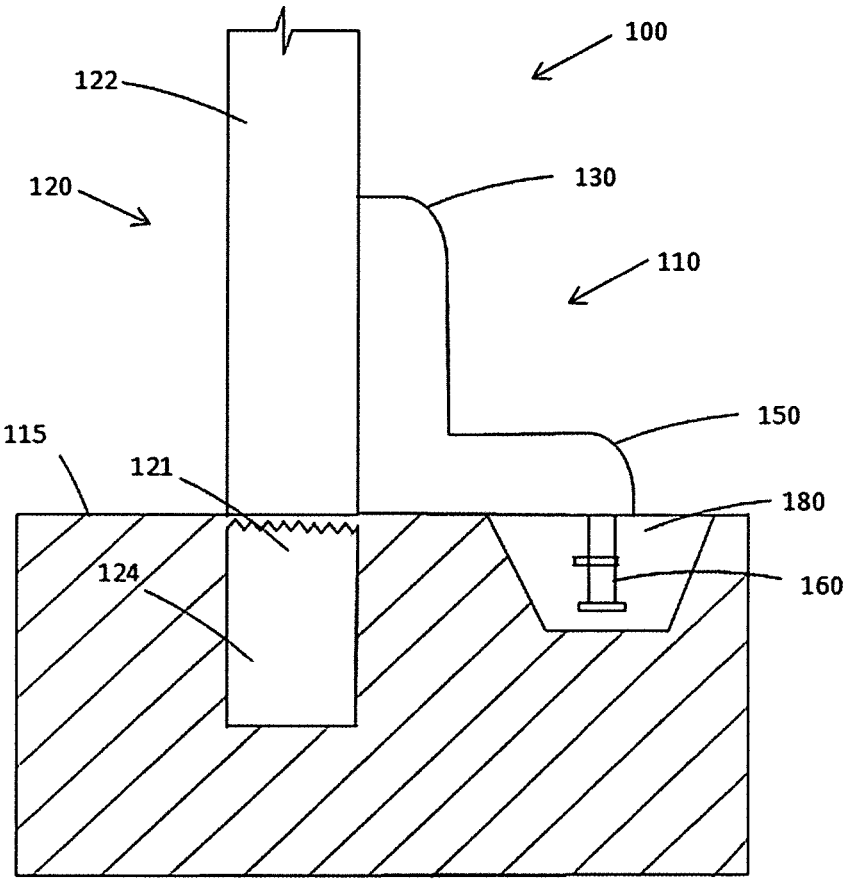
FIG. 2 illustrates an elevational side view of the anchored support attached to the at least partially fractured column.

An exemplary embodiment of the invention is illustrated FIG. 1. FIG. 1 shows an anchored support system 100. The anchored support system 100 comprises at least one anchored support 110. The at least one rigid member 110 may be configured to be coupled to a structure needing a secondary support, such as, for example, at least one column 120. Column 120 may comprise a fence post, such as a wooden or metal fence post. In further embodiments, column 120 may comprise posts, trees, pillars, signs, or other structures which may need support. As shown in FIG. 1, at least one column 120 may comprise at least a first section 122 and at least a second section 124 separated by the at least partial fracture 121. The at least a first section 122 may be positioned outside of supporting foundation 115. The at least a first section 122 may be at least partially detached from the at least a second section 124. Alternatively the at least a first section 122 may be completely detached from the at least a second section 124. The at least partial fracture 121 may be the result of fatigue, rot, rust, impact, or other causes. Referring briefly to FIG. 2, the at least a second section 124 may be at least partially contained within the supportive foundation 115. Alternatively, the at least a second section 124 may be completely contained within the supportive foundation 115. In other embodiments, the at least a first section 122 may be partially contained within the supportive foundation 115. In an exemplary embodiment, the supportive foundation 115 may be earth or soil, or in alternative embodiments, may comprise materials such as for example, ground, dirt, concrete, and building structures.

The at least one column 120 may protrude upward from the supportive foundation 115. In other embodiments, the at least one column 120 may protrude in any direction from the supportive foundation 115, such as, for example, horizontally, diagonally, downwardly, or in another direction, as needed.

Referring again to FIG. 1, in some embodiments, the at least a first rigid member 110 may comprise at least a first member 130. The at least a first member 130 may be configured to attach to at least a portion of the at least a first section 122 of the at least one column 120. In the exemplary embodiment shown in FIG. 1, the at least a first member 130 of the at least a first rigid member 110 is shown attached to the first section 122 of the at least one column 120. As shown in FIG. 2, the at least a first member 130 may attach to the at least a first section 122 using any appropriate means, including but not limited to at least one fastener 135 coupling the at least a first member 130 to the at least a first section 122 by passing through opening 140 in the at least a first member 130. The at least one fastener 135 may comprise at least one bolt passing through the at least a first member 130 and into at least one opening in the at least a first section 122, at least one bolt with a washer passing through the at least a first member 130 and into at least one opening in the at least a first section 122, at least one bolt passing through the at least a first member 130 and passing through at least one opening in the at least a first section 122 with a nut fastening to the end of the bolt or alternatively, a pin fastening to the end of the bolt to secure the bolt in place. In other embodiments, the at least a first member 130 may be coupled to the at least a first section 122 by tongue and groove joint, a hook and a notched opening, an adhesive, such as for example, glue and epoxy, nails, brackets, and straps. Additionally, the at least one fastener 135 may comprise more than one fastener, such as for example two fasteners, three fasteners, four fasteners, or any other number of appropriate fasteners. Furthermore, the at least one opening 140 may comprise more than one opening, such as, for example, two openings, three openings, four openings, or any other number of appropriate openings to secure the at least a first member 130 to the at least a first section 122. Similarly, the at least a first section 122 may comprise a corresponding number of openings.

Referring again to FIG. 1, at least a second section 150 may be configured to be attached to the at least a first member 130. As illustrated by the exemplary embodiment of FIG. 1, the at least a second member 150 is attached to the at least a first member 130. In some embodiments, the at least a second member 150 may be fixedly coupled to the at least a first member 130. In some embodiments the at least a second member 150 may be integrally formed with the at least a first member 130. In other embodiments, the at least one rigid member 110 may comprise the at least a second member 150, which may be detachably coupled to the at least a first member 130. The at least a second member 150 may be coupled to the at least a first member 130 using a fastener such as, for example, a bolt and nut combination. Alternatively, the at least a second member 150 may be coupled to the at least a first member 130 using a hinged jointed, such that the at least a second member 150 may fold toward the at least a first member 130, or alternatively, may fold away from the at least a first member 130.

As shown in the exemplary embodiment of FIG. 1, the anchored support system 100 may further comprise at least a second rigid member 160. The at least a second rigid member 160 may be detachably coupled to the at least a first rigid member 110. The at least a second rigid member 160 may be configured to be coupled to the at least a first rigid member 110. In exemplary embodiments the at least a second rigid member 160 may be detachably coupled to the at least a first rigid member 110, as will be explained hereinafter. In other embodiments, the at least a second rigid member 160 may be integrally formed with the at least a first rigid member 110.

Referring now to FIG. 2, a profile or elevation view of the anchored support system 100 is shown. The at least a first member 130 of the at least one rigid member 110 is shown being coupled to the at least a first section 122 of the at least one column 120. The at least a first section 122 is at least partially separated from the at least a second section 124. The at least a first section 122 may be at least partially outside of the supportive foundation 115. The at least a second section 124 may be at least partially contained within the supportive foundation 115. In some embodiments, such as shown in FIG. 2, the at least a first section 122 is separated from the at a second section 124 at the level of the supportive foundation 115. In the embodiment of FIG. 2, the at least a first section 122 may be completely outside of the supportive foundation 115. In the embodiment of FIG. 2, the at least a second section 124 may be surrounded within the supportive foundation 115, as shown.

As described above, FIG. 2 also shows a profile view of the at least one member 130 of the at least a first rigid member 110 coupled to the at least a first section 122. As discussed above, the at least a first member 130 may be coupled to the at least a first section 122 by a bolt, washer, nut combination, by bolt, or by bolt and nut. The at least a second section 150 of the at least a first rigid member 110 is also illustrated in FIG. 2. The at least a second section 150 may be oriented perpendicularly to the at least a first member 130. In other embodiments, the at least a second section 150 may be oriented at an angle from the at least a first member 130, the angle being at least one of acute and obtuse.

FIG. 2 further shows a void 180 within the supportive foundation 115. The void 180 may comprise a hole formed in the supportive foundation 115. The void 180 may be configured to recess into the supportive foundation 115. The void 180 may be configured to receive the at least a second rigid member 160. The void 180 may have an acceptable cross-sectional shape. For example, the void 180 may be circular, rectangular, square, triangular, elliptical, or may have any other suitable cross-section. The edges of the void 180 may be jagged or smooth. Additionally, the void 180 may extend in the supportive foundation 115 uniformly, or may be wider at the surface of the supportive foundation 115 and narrower as the void 180 extends into the interior of the supportive foundation 115. Alternatively, the void may be narrower at the surface of the supportive foundation 115 and wider as the void 180 extends into the interior of the supportive foundation 115.

In some embodiments, the void 180 may be large enough to receive the at least a second rigid member 160. In one embodiment the void 180 may extend into the supportive foundation 115 18 inches. In other embodiments, the void 180 may extend into the supportive foundation 115 beyond 18 inches. In other embodiments, the void 180 may extend into the supportive foundation less than 18 inches.

Figure 3:
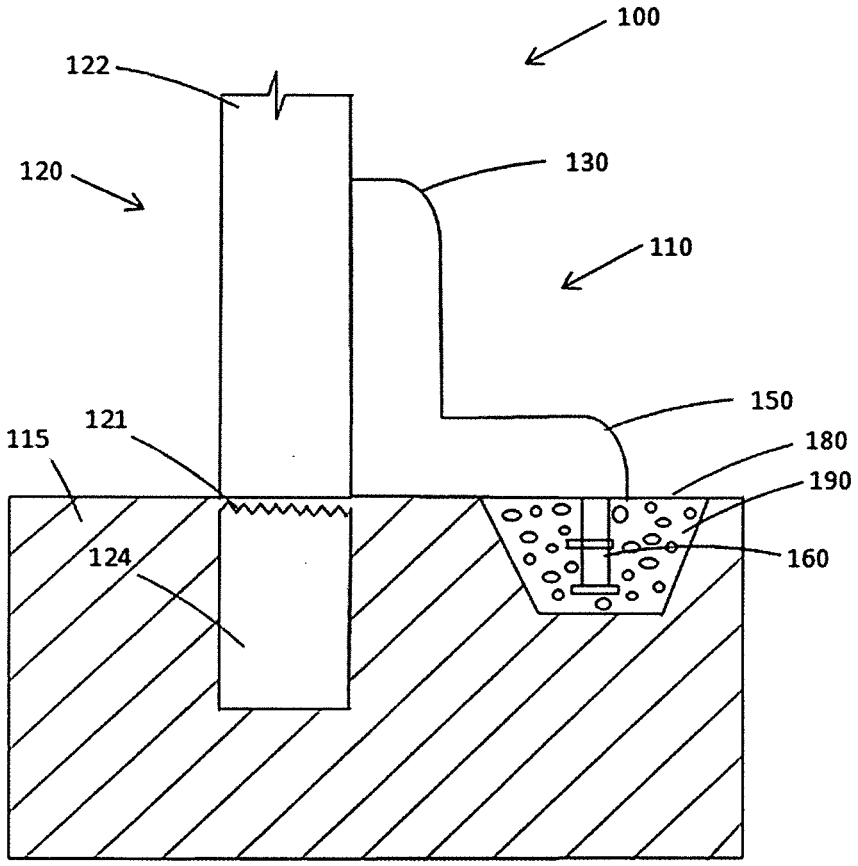
FIG. 3 illustrates an elevational side view of a further embodiment of the anchored support attached to the at least partially fractured column.

As shown in FIG. 3, the void 180 may be configured to receive a supportive medium 190. The supportive medium 190 may be configured to be deposited into the void 180. The supportive medium 190 may be configured to provide a strong and secure material to provide support to the at least a second rigid member 160, such that the at least a second rigid member experiences little to no movement, or at least no substantial or significant movement. In some embodiments supportive material 190 may comprise cement, concrete, or other similar curable material, including recycled materials, ash-based materials, and other organic based materials. In some embodiments, supportive material 190 may include simple dirt, soil, gravel, or other similar material.

In an exemplary embodiment, supportive material 190 may be a concrete material. Supportive material 190 may be prepared to be placed within the void 180 prior to placing supportive material 190 within the void 180. The supportive material 190, the concrete material, may be unprepared, in dry a dry powder and may be mixed with water. After mixing the concrete material and the water together, the mixture may be poured into the void 180.

The at least a second rigid member 160 may be placed within the void 180 prior to pouring in the mixture of dry concrete powder and water into the void 180. In other embodiments the at least a second rigid member 160 may be placed within the void 180 after the mixture has been placed into the void 180.

Figure 4:
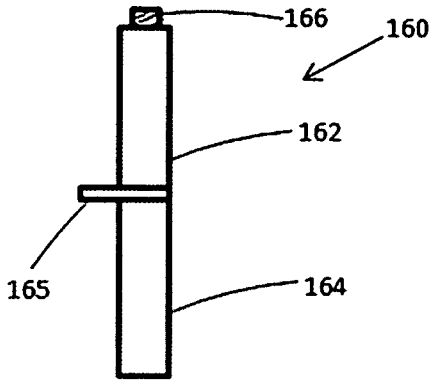
FIG. 4 illustrates a side view of a component of the anchored support.

Referring to FIG. 4, the at least a second rigid member 160 may comprise at least a first member 162 coupled to at least a second member 164. The at least a first member 162 may be integrally formed with the at least a second member 164. In other embodiments, the at least a first member 162 may be detachably coupled to the at least a second member 164.

At least one structure 165 may be attached to the at least a second rigid member 160. The at least one structure 165 may be configured to prevent the at least a second rigid member 160 from rotating within the supportive medium 190. The at least one structure 165 may be offset from the longitudinal axis of the at least a second rigid member 160. The at least one structure 165 may comprise a structure such as a washer, a piece of angle iron, a piece of material extending from the at least a second rigid member 160. The at least one structure 165 may comprise a shape such as, for example, a circular shape, a rectangular shape, a triangular shape, an elliptical shape, or other appropriate shape. The at least one structure 165 may have any appropriate thickness. The at least one structure 165 may be fixed at any point along the at least an additional rigid member 160. The at least one structure 165 may be oriented at any angle with respect to the longitudinal axis of the at least an additional rigid member 160, including 0°, 30°, 45°, 60°, and 90° degrees, or any range therein. The at least one structure 165 may comprise any suitable material, such as, for example, iron, steel, aluminum, other metals, carbon fiber, plastics, or the like. The at least one structure 165 may be coupled to the at least a second rigid member by welding, press fit, adhesive, a hook and notch configuration, and the like. In other embodiments, the at least one structure may comprise a roughened surface on the at least a second rigid member 160.

As described herein, a user may wish to either permanently or temporarily remove the at least a first rigid member 130 from the at least an additional rigid member 160 by decoupling the at least a first rigid member 130 from the at least an additional rigid member 160. At times, this will require that the at least a first rigid member 130 be rotated with respect to the at least an additional rigid member 160. The at least one structure 165 may prevent the at least an additional rigid member 160 from rotating with the at least a first structure 160.

Figure 5:
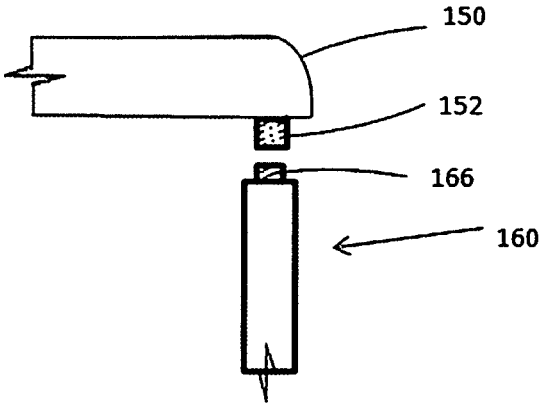
FIG. 5 illustrates a side view of components of the anchored support.
Figure 7:
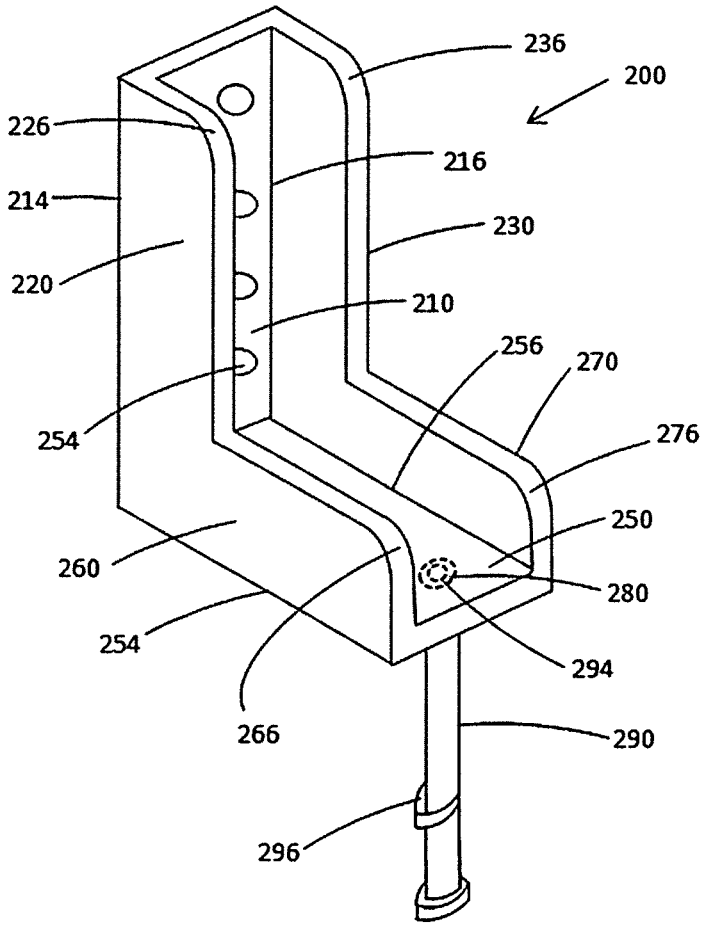
FIG. 7 illustrates a perspective view of another embodiment of the anchored support.

As illustrated in FIG. 5, a cross-sectional view shows that the at least a second member 150 of the at least a first rigid member may comprise an at least a first threaded surface 152, extending from the at least a second member 150 in a direction opposite of the channels 155. The at least a first threaded surface 152, as shown in FIG. 7, may be a female threaded surface.

Figure 6:
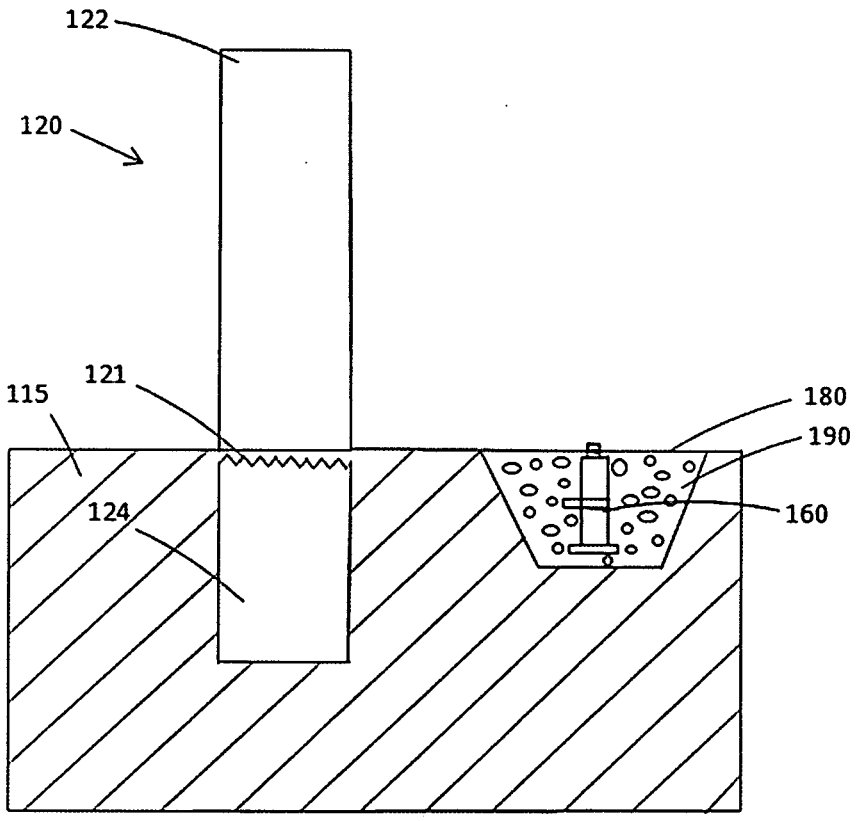
FIG. 6 illustrates a side view of a component of the anchored support

Referring to FIGS. 4 and 5, the at least a second rigid member 160 may further comprise a shaft with a hollow center. The at least a second rigid member 160 may further comprise at least a second threaded surface 166. As shown in FIG. 6, the at least a second threaded surface 166 may comprise a male threaded surface configured to couple to a female threaded surface, as discussed herein below. The male mating joint and the corresponding female mating joint may be referred to herein as couplings, fasteners, or other term well-known in the art. In other embodiments, the interior of the hollow center may be configured with other types of coupling mechanisms, such as, for example a clamped joint, a tongue and groove coupling, or other means known in the art. In further embodiments, the first threaded surface 152 may be configured to fit within the at least a second threaded surface 166, detachably coupling the at least a first rigid member 110 to at least the second rigid member 160. In other embodiments, the threaded surface 152 may comprise a collar having an interior threaded surface slidably attached to an extrusion from the at least a second member 150, configured to threadably couple with the at least a second threaded surface 166. In yet further embodiments, the threaded surface 152 may comprise a male threaded surface, configured to detachably couple to a female threaded surface 164 of the at least a second rigid member 160.

In yet further embodiments, the coupling between the at least a first rigid member 110 and the at least a second rigid member 160 may be done by any suitable detachable coupling means, such as, for example, threaded fittings, a clamped joint, a tongue and groove coupling, or other means known in the art. The at least a first rigid member 110 may be detached from the at least a second rigid member 160 by decoupling the at least a first rigid member 110 from the at least a second rigid member 160. For example, the at least a first rigid member 110 may comprise a female coupling joint having a set of threads. The at least a second rigid member 160 may comprise a male coupling joint having a set of mating threads configured to mate with the female threads of the at least a first rigid member 110. The at least a first rigid member 110 may be rotated, unscrewing the at least a first rigid member 110 from the at least a second rigid member 160. The at least a second rigid member 160 may remain secured within the supportive material 190. The at least a first rigid member 110 may be detached from the first section 122 of the at least a first column 120. Any bolts, screws, or other fasteners may be removed from the at least a first section 122 and the at least a first rigid member 110, allowing the at least a first rigid member 110 to have multiple degrees of freedom. The at least a first rigid member 110 may then be detached from the at least a second rigid member 160. This may be accomplished by rotating the at least a first rigid member 110 from the at least a second rigid member 160, completely detaching the at least a first rigid member 110 from the at least a second rigid member 160. The at least one structure 165 may be configured to prevent the rotation of the at least a second rigid member 160 while in the ground, allowing the at least a first rigid member 110 to be unscrewed or decoupled from the at least a second rigid member 160. In further embodiments, a cap 200 may then be placed on the threaded surface 166 of the at least a second rigid member 160. Alternatively, the cap 200 may be configured to have complimentary mating or coupling means to the at least a second rigid member 160. The cap 200 may be configured to prevent dirt, rocks, water, weather, and debris from entering the interior of the at least a second rigid member 160.

It is contemplated that a user such as a homeowner, landlord, business owner, or lawn or yard care professional may deem it desirable or necessary to remove the column 120. Such a decision will also prompt the necessity of removing the at least a first rigid member 110. However, as contemplated herein, this does not require that the user move the at least a second rigid member 160. As illustrated in FIG. 6, the at least a second rigid member 160 may remain anchored in the supportive material 190 if the at least a first rigid member 110 is removed and will not be replaced, or, alternatively, if the at least a first rigid member 110 is removed and will be replaced at later time. This will allow a user to have the convenience of removing the at least a first rigid member 110 without having to remove the supportive material 180. The user is then free to use the surface fir whatever purpose deemed appropriate. Alternatively, the user may elect to remove the at least a first rigid member 110 for a period of time, protecting the at least a second rigid member 160 by placing the cap 200 on the at least a second rigid member, and subsequently removing the cap 200 and reinstalling the at least a first rigid member 110.

Further embodiments of the invention include methods of installing or using the anchored support system 100 in the supportive foundation 115. Specifically, as illustrated by FIG. 1, the methods include coupling to the at least one section 122 of the column 120 adjacent to the supportive foundation 115 the at least a first rigid member 110. As described herein above, the at least a first rigid member 110 may be coupled to the at least one section 122 using any suitable method including a combination of a bolt, washer, and nut, a bolt and a washer, a bolt only, by tongue and groove joint, a hook and a notched opening, an adhesive, such as for example, glue and epoxy, nails, brackets, and straps. The at least one rigid member 110 may be configured to be joined to an additional rigid member, such as, for example, the at least a second rigid member 160. The at least a second rigid member 160 may comprise a structure 165 configured to prevent rotation of the at least an a second rigid member within a supportive medium, such as for example the supportive medium 190, shown in FIG. 3 and FIG. 6. The method may further comprise forming a void, such as the void 180, illustrated in FIG. 2, within the supportive foundation 115. The method of funning the void may vary depending on the nature of the supportive material 115, however, the methods may include digging, chiseling, using an auger, using other well know material removing tools, or other methods known in the art.

The method may further comprise positioning the at least a second rigid member 160 at least partially within a void, such as the void 180 shown in FIG. 2, the void 180 being within the supportive foundation 115. Alternatively, the at least a second rigid member 160 may be positioned within the void 180, such that the at least a second rigid member is completely positioned within the void 180. The void 180 may be positioned in proximity to the column 120, at a distance no greater and no less than the length of the at least a second member 150. In some instances, this will be adjacent to the column 120. The method may further comprise preparing a supportive material, such as supportive material 190 shown in FIG. 3 and FIG. 6, to be placed within the void 180, surrounding the at least a second rigid member 160 within the void 180. The method comprises placing around the at least a second rigid member 160 a supportive material configured to prevent substantial movement of the at least a second rigid member 160. The supportive material may comprise cement, concrete, or other similar curable material, including recycled materials, ash-based materials, and other organic based materials. In some embodiments, supportive material 190 may include simple dirt, soil, gravel, or other similar material. As indicated the method may include preparing the supportive material 190. This may include mixing a powder-like substance with a liquid, forming the supportive material 190. Thereafter, the method may include placing the material around or about the at least a second rigid member 160 within the void 180 and allowing the supportive material 190 to cure. The method may also include providing a finish to the exposed surface of the supportive material 190.

The method may further comprise positioning the at least a second rigid member 160 within the void 180 and within the supportive medium 190 such that the structure 165 prevents rotation of the at least an additional rigid member 160. This method may include at least partially rotating the at least a second rigid member 160 within the supportive medium 190 to secure the position of the at least a second rigid member 160. The structure 165, as described herein above, may be positioned on the at least an additional rigid member 160 in a position offset from the longitudinal axis of the at least a second rigid member 160

The method may further comprise coupling a first section 130 of the at least a first rigid member 110 to a at least one section 122 of a column 120, the at least a first section 130 being coupled to the at least a second member 150 of the at least a first rigid member 110 and the at least a second member 150 may extend at an angle from the at least a first section 110. Depending on the orientation of the column 120 to the supportive foundation 115, the angle may vary. The angle may include acute angles, right angles, and obtuse angles.

The method may further comprise at least partially surrounding the at least a second rigid member 160 within the supportive medium 190. For example the supportive medium 190 may include concrete; the concrete may be poured to surround only a portion of the at least a second rigid member 160 or, alternatively may cover the entire length of the at least a second rigid member 160. This may depend on the depth of the void 180 which is formed, which, as discussed herein above, may be 18 inches, or, alternatively greater than or less than 18 inches.

The method may also include decoupling the at least a second rigid member from the at least a second member 150 of the at least a first rigid member 110 after the supportive medium 190 has been deposited within the void 180.

In further embodiments, the method may further comprise protecting the at least a second rigid member 160. Such protection may be accomplished by placing the cap 200 over an at least partially exposed portion of the at least a second rigid member 160. The cap may be screwed onto the second threaded surface 166 of the at least an additional rigid member 160, or may be attached by other suitable means, depending on the configuration of the coupling means on the at least an additional rigid member 160.

Further embodiments of the present invention are shown in FIG. 7. These embodiments include a anchor 200 for supporting or reinforcing a column. The anchor 200 may comprise a first channeled section 210 configured to be attached to a column. The first channel section 210 may be attached to column by any appropriate means, including by the use of fasteners, such as by bolts, or a combination of bolts, washers, and nuts, screws, nails. Alternatively, these may be joined by other coupling means, such as by a tongue and groove joint, or by an adhesive, such as epoxy, glue, or the like.

The first channeled section 200 may comprise a first channel wall 220 of the first channel section 210 extending along a first edge 214. The anchor 200 may further comprise a second channel wall 230 extending along a second edge 216 opposite the first edge 214. The first channel wall 220 and the second channel wall 230 may extend perpendicularly from the first channel section 210. The first channel wall 220 may extend from the first channel wall 210 any appropriate distance, including, for example, one or two inches. The second channel wall 230 may extend the same distance as the first channel wall 220, or alternatively, may extend a shorter distance, or in some embodiments, a further distance.

The anchor 200 may further comprise a second channeled section 250 configured to be attached to the first channeled section 210 and extending at an angle therefrom. The second channel section 250 may be integrally formed with the first channel section 210, or alternatively may be fixedly attached to the first channel section 210. This attachment may include welding. In alternative embodiments, the second channel section 250 may be detachably coupled to the first channel section 210, allowing to detach the second channel section 250 from the first channel section 210. This attachment may be by hinges or by fasteners, as herein described.

The second channel section 250 may extend at any angle from the first channel section 210, including a right angle, an acute angle, and an obtuse angle.

The second channeled section 250 may comprise a third channel wall 260 of the second channeled section 250 extending the length of the second channeled section along a third edge 254 of the second channel section 250. The anchor 200 may further comprise a fourth channel wall 270 of the second channeled section 250 extending the length of the second channel section 250 along a fourth edge 256 of the second channel section 250. The fourth edge 256 of the second channel section 250 may be opposite the third edge 254 of the second channel section 254.

The second channeled section 250 may comprise a third channel wall 260 of the second channel section 250 extending along a third edge 254. The anchor 200 may further comprise a fourth channel wall 270 extending along a fourth edge 256 opposite the third edge 254. The third channel wall 260 and the fourth channel wall 270 may extend perpendicularly from the second channel section 250. The third channel wall 260 may extend from the second channel wall 250 any appropriate distance, including, for example, one or two inches. The fourth channel wall 270 may extend the same distance as the first channel wall, or alternatively, may extend a shorter distance, or in some embodiments, a farther distance.

Further embodiments of the present invention may include wherein the first channel wall comprises chamfered or rounded corners. For example the first channel wall 220 may comprise a chamfered or rounded corner 224. In further embodiments, the second channel wall may comprise chamfered or rounded edges. For example, the second channel wall 230 may comprise a chamfered or rounded corner 236. In further embodiments, the third channel wall may comprise chamfered or rounded edges. For example, the third channel wall 260 may comprise a chamfered or rounded corner 266. In further embodiments, the fourth channel wall may comprise chamfered or rounded edges. For example, the fourth channel wall 260 may comprise a chamfered or rounded corner 276. In some embodiments, all of the channel walls may have chamfered or rounded edges; alternatively, a fraction of the channel walls may have chamfered or rounded edges, or in some embodiments, none of the channel walls may have chamfered or rounded edges.

The anchor 200 may further comprise a first coupling member 280 attached to the second channeled section 250 opposite the first channel wall 254 and the second channel wall 256. The first coupling member 280 may comprise a threaded section configured to mate with a second threaded section.

The anchor 200 may comprise a tubular section 290. The tubular section 290 may comprise a second coupling member 294 at a proximal end of the tubular section 290. The second coupling member 294 may comprise a threaded section configured to mate with the first coupling member 280. The tubular section 290 may be configured to detachably couple to the first coupling member 280 of the second channel section 250. Furthermore, the tubular section 290 may be configured to extend in a direction substantially opposite of the first channel section 210 and may be configured to be anchored within a supportive medium. Additionally, the second coupling member 294 may be configured to decouple from the first coupling member 280. The tubular section 290 may comprise a structure 296 configured to prevent rotation of the tubular section 290.

In the embodiments herein described, the anchor 200 may comprise any suitable material, including steel, iron, aluminum, other metals, carbon fiber, plastics, polymers, and the like. In some embodiments, some components may comprise a different material than the rest of the components. For example, the channel sections 210 and 250 may comprise iron, while the channel walls 220, 230, 260, and 270 may each comprise a plastic.

In further embodiments of the present invention, the anchor 200 may be integrally formed. In alternative embodiments, different components may be joined together by welding or by fasteners.

Further embodiments of the present invention may include methods of manufacturing or forming a column-supporting anchor, such as the anchor 200. A method of forming the anchor 200 comprises forming at least one rigid member, such as the first channel section 210. The method further comprises coupling at least an additional rigid member, such as the second channel section 250, to at least one rigid member, such as the first channel section 210. The method further comprises attaching to at least an additional rigid member, such as the second channel section 250, a structure, such as the structure 296, configured to prevent rotation of at least an additional rigid member, such as the second channel 250, when the structure 296 is in contact with an external supportive material. The external supportive material may comprise a material such as, for example concrete.

The method of manufacturing or forming the column-supporting anchor may further comprise fixedly attaching a first coupling attachment, such as, for example, first coupling member 280, to at least one rigid member, such as, for example, the first channel section 210. The method may also comprise fixedly attaching a second coupling attachment, such as, for example, the second coupling member 294, to at least an additional rigid member, such as, for example, the second channel section 250. The second coupling member 294 may be configured to couple to the first coupling attachment or coupling member 280.

Further embodiments of the present invention are shown in FIG. 7. These embodiments include a anchor 200 for supporting or reinforcing a column. The anchor 200 may comprise a first channeled section 210 configured to be attached to a column. The first channel section 210 may be attached to column by any appropriate means, including by the use of fasteners, such as by bolts, or a combination of bolts, washers, and nuts, screws, nails. Alternatively, these may be joined by other coupling means, such as by a tongue and groove joint, or by an adhesive, such as epoxy, glue, or the like.

Methods of manufacturing the support may include forming the first channeled section 210. The method may comprise forming a first channel wall 220 of the first channel section 210 extending along a first edge 214. Manufacturing the support 200 may further comprise forming a second channel wall 230 extending along a second edge 216 opposite the first edge 214. The first channel wall 220 and the second channel wall 230 may be formed to extend perpendicularly from the first channel section 210. The first channel wall 220 may extend from the first channel wall 210 any appropriate distance, including, for example, one or two inches. The second channel wall 230 may extend the same distance as the first channel wall 220, or alternatively, may extend a shorter distance, or in some embodiments, a further distance.

Forming the anchor 200 may further comprise forming a second channeled section 250 configured to be attached to the first channeled section 210 and extending at an angle therefrom. The second channel section 250 may be integrally formed with the first channel section 210, or alternatively may be formed and subsequently fixedly attached to the first channel section 210. The method of attachment may include welding. In alternative embodiments, the second channel section 250 may be detachably coupled to the first channel section 210, whereby the second channel section 250 may detach from the first channel section 210. This attachment may be by hinges or by fasteners, as herein described.

The second channel section 250 may be formed to extend at any angle from the first channel section 210, including a right angle, an acute angle, and an obtuse angle.

Manufacturing the second channeled section 250 may comprise forming a third channel wall 260 of the second channeled section 250 extending the length of the second channeled section along a third edge 254 of the second channel section 250. Forming the anchor 200 may further comprise forming a fourth channel wall 270 of the second channeled section 250 extending the length of the second channel section 250 along a fourth edge 256 of the second channel section 250. The fourth edge 256 of the second channel section 250 may be formed opposite the third edge 254 of the second channel section 254.

Forming the second channeled section 250 may comprise forming a third channel wall 260 of the second channel section 250 extending along a third edge 254. Forming the anchor 200 may further comprise forming a fourth channel wall 270 extending along a fourth edge 256 opposite the third edge 254. The third channel wall 260 and the fourth channel wall 270 may be formed to extend perpendicularly from the second channel section 250. The third channel wall 260 may be formed to extend from the second channel wall 250 any appropriate distance, including, for example, one or two inches. The fourth channel wall 270 may be formed to extend the same distance as the first channel wall, or alternatively, may extend a shorter distance, or in some embodiments, a further distance.

Further embodiments of the present method may include forming chamfered or rounded corners on the first channel wall. For example, forming the first channel wall 220 may comprise forming a chamfered or rounded corner 224. In further embodiments, forming the second channel wall may comprise forming chamfered or rounded edges. For example, forming the second channel wall 230 may comprise forming the chamfered or rounded corner 236. In further embodiments, forming the third channel wall may comprise forming chamfered or rounded edges. For example, forming the third channel wall 260 may comprise forming the chamfered or rounded corner 266. In further embodiments, forming the fourth channel wall may comprise forming chamfered or rounded edges. For example, forming the fourth channel wall 260 may comprise forming the chamfered or rounded corner 276. In some embodiments, all of the channel walls may be manufactured to have chamfered or rounded edges; alternatively, only some of the channel walls may be manufactured with chamfered or rounded edges, or in some embodiments, none of the channel walls may be manufactured with chamfered or rounded edges.

Forming the anchor 200 may further comprise forming the first coupling member 280 and attaching the first coupling member to the second channeled section 250 opposite the first channel wall 254 and the second channel wall 256. The first coupling member 280 may be formed to include a threaded section configured to mate with a second threaded section.

Forming the anchor 200 may comprise forming a tubular section 290. Forming the tubular section 290 may comprise forming the second coupling member 294 at a proximal end of the tubular section 290. Forming the second coupling member 294 may comprise forming a threaded section configured to mate with the first coupling member 280. The tubular section 290 may be formed and configured to detachably couple to the first coupling member 280 of the second channel section 250. Furthermore, the tubular section 290 may be configured to extend in a direction substantially opposite of the first channel section 210 and may be configured to be anchored within a supportive medium. Additionally, the second coupling member 294 may be formed such that it is configured to decouple from the first coupling member 280. The tubular section 290 may comprise a structure 296 configured to prevent rotation of the tubular section 290.

In the embodiments herein described, the anchor 200 may be formed from any suitable material, including steel, iron, aluminum, other metals, carbon fiber, plastics, polymers, and the like. In some embodiments, some components may comprise a different material than the rest of the components. For example, the channel sections 210 and 250 may comprise iron, while the channel walls 220, 230, 260, and 270 may each comprise a plastic.

In further embodiments of the present invention, the anchor 200 may be integrally formed. In alternatively embodiments, different components may be joined together by welding or by fasteners.

While the descriptions herein are described with respect to fences, columns, posts, trees, and other structures, and attaching the anchor 200 directly to these objects, it is further contemplated that the anchor 200 may be attached to and provide support to a structure in other ways. For example, the anchor 200 may be free-standing and may be coupled to a structure by a means of a cable or a rope.

Although the foregoing description contains many specifics, these are not to be construed as limiting the scope of the present invention, but merely as providing certain embodiments. Similarly, other embodiments of the invention may be devised which do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

EMBODIMENTS

The following illustrate embodiments of the present invention:

Embodiment 1

An anchored support to buttress a column, comprising: at least one rigid member configured to be coupled to at least one section of a column; and at least an additional rigid member configured to be detachably coupled to the at least one rigid member and configured to be positioned at least partially within a supportive medium, wherein the at least an additional rigid member comprises a structure configured to prevent rotation of the at least an additional member.

Embodiment 2

The anchored support of embodiment 1, wherein the structure configured to prevent rotation of the at least an additional member is fixedly attached to the at least one additional member.

Embodiment 3

The anchored support of embodiment 2, wherein the structure configured to prevent rotation of the at least an additional member is configured to fit around at least a portion of the at least one additional member.

Embodiment 4

The anchored support of embodiment 3, wherein the structure configured to prevent rotation of the at least an additional member is fixedly attached to the at least one additional member in a position offset from a longitudinal axis of the at least one additional member.

Embodiment 5

The anchored support of embodiment 1, wherein the at least one rigid member comprises at least a first section and at least a second section, wherein the first section and the second section are configured to be coupled together, wherein the second section is configured to extend from the first section at an angle therefrom, the second section being configured to detachably couple to the at least an additional rigid member.

Embodiment 6

The anchored support of embodiment 5, wherein the first section comprises a first channeled section having a first pair of channel walls extending the length of the first section on opposing edges of the first section, and wherein the second section comprises a second channeled section having a second pair of channel walls extending the length of the second section on opposing edges of the second section.

Embodiment 7

The anchored support of embodiment 6, wherein each wall of the first pair of channeled walls has a rounded corner and wherein each wall of the second pair of channeled walls has a rounded corner.

Embodiment 8

The anchored support of embodiment 7, wherein the at least an additional rigid member comprises a first coupling joint.

Embodiment 9

The anchored support of embodiment 8, wherein the at least an additional rigid member comprises a second coupling joint, the second coupling joint configured to couple with the first coupling joint, coupling the at least an additional rigid member to the at least one rigid member.

Embodiment 10

The anchored support of embodiment 9, wherein the first coupling joint is configured to decouple from the second coupling joint.

Embodiment 11

A method of anchoring a column comprising: coupling to at least one section of a column adjacent to a supportive foundation at least one rigid member being joined to at least an additional rigid member having a structure configured to prevent rotation of the at least an additional rigid member within a supportive medium; positioning the at least an additional rigid member at least partially within a void, the void being within a supportive foundation and in proximity to the column; placing around the at least an additional rigid member a supportive medium configured to prevent substantial movement of the at least an additional rigid member.

Embodiment 12

The method of embodiment 11, wherein positioning the at least an additional rigid member within the void further comprises positioning a structure fixedly attached to the at least an additional rigid member to prevent rotation of the at least an additional rigid member.

Embodiment 13

The method of embodiment 12, wherein positioning the at least an additional rigid member within the void further comprises positioning the at least an additional member having the structure fixedly attached to the at least an additional rigid member in a position offset from a longitudinal axis of the at least one additional rigid member.

Embodiment 14

The method of embodiment 13, wherein coupling the at least one rigid member to at least one section of a column further comprises coupling at least a first section of the at least one rigid member to a at least one section of a column, the at least a first section being coupled to at least a second section of the at least one rigid member, the at least a second section extending at an angle from the at least a first section.

Embodiment 15

The method of embodiment 14, further comprising at least partially surrounding the at least additional rigid member within the supportive medium; and decoupling the at least an additional rigid member from the second section.

Embodiment 16

The method of embodiment 15, further comprising protecting the at least additional rigid member with a cap over an at least partially exposed portion of the at least an additional rigid member.

Embodiment 17

A column supporting anchor, comprising: a first channeled section configured to be attached to a column, the first channeled section having a first channel wall of the first channel section extending along a first edge and a second channel wall extending along a second edge opposite the first edge; and a second channeled section configured to be attached to the first channeled section and extending at an angle therefrom, wherein the second channeled section comprises: a third channel wall of the second channeled section extending the length of the second channeled section along a third edge of the second channel section; a fourth channel wall of the second channeled section extending the length of the second channel section along a fourth edge of the second channel section, the fourth edge of the second channel section being opposite the third edge of the second channel section; and a first coupling member attached to the second channeled section opposite the first channel wall and the second channel wall; a tubular section comprising: a second coupling member at a proximal end of the tubular section and configured to detachably couple to the first coupling member of the second channel section, wherein the tubular section extends in a direction substantially opposite of the first channel section and configured to be anchored within a supportive medium, wherein the second coupling member is configured to decouple from the first coupling member; and a structure fixedly attached to the tubular section and configured to prevent rotation of the tubular section within a supportive medium.

Embodiment 18

The column-supporting anchor of embodiment 17, wherein the first channel wall has rounded corners; the second channel wall has rounded corners; the third channel wall has rounded corners; and the fourth channel wall has rounded corners.

Embodiment 19

A method of forming a column-supporting anchor, comprising: forming at least one rigid member; coupling at least an additional rigid member to the at least one rigid member; and attaching to the at least an additional rigid member a structure configured to prevent rotation of the at least an additional rigid member when the structure is in contact with an external supportive material.

Embodiment 20

The method of embodiment 20, further comprising: fixedly attaching a first coupling attachment to the at least one rigid member; fixedly attaching a second coupling attachment to the at least an additional rigid member configured to couple to the first coupling attachment.

What is claimed is:

1. A column-supporting anchor comprising:

a first channeled section configured to be attached to a column, the first channeled section having a first channel wall of the first channel section extending along a first edge and a second channel wall extending along a second edge opposite the first edge;

a second channeled section configured to be attached to the first channeled section and extending at an angle therefrom, wherein the second channeled section comprises:

a third channel wall of the second channeled section extending the length of the second channeled section along a third edge of the second channel section;

a fourth channel wall of the second channeled section extending the length of the second channel section along a fourth edge of the second channel section, the fourth edge of the second channel section being opposite the third edge of the second channel section; and a first coupling member attached to the second channeled section opposite the first channel wall and the second channel wall;

a tubular section comprising:

a second coupling member at a proximal end of the tubular section and configured to detachably couple to the first coupling member of the second channel section, wherein the tubular section extends in a direction substantially opposite of the first channel section and configured to be anchored within a supportive medium, wherein the second coupling member is configured to decouple from the first coupling member; and a structure fixedly attached to the tubular section and configured to prevent rotation of the tubular section within a supportive medium.

2. The anchor of claim 1, wherein:

the first channel wall has rounded corners;

the second channel wall has rounded corners;

the third channel wall has rounded corners; and the fourth channel wall has rounded corners.

* * * * *